US010621902B2

(12) United States Patent
Li et al.

(10) Patent No.: US 10,621,902 B2
(45) Date of Patent: Apr. 14, 2020

(54) DRIVING CIRCUIT FOR DISPLAY SCREEN WITH ADJUSTABLE COLOR DEPTH BIT VALUE, DISPLAY METHOD AND DISPLAY DEVICE

(71) Applicants: BEIJING BOE OPTOELECTRONICS TECHNOLOGY CO., LTD., Beijing (CN); BOE TECHNOLOGY GROUP CO., LTD., Beijing (CN)

(72) Inventors: Yan Li, Beijing (CN); Zijiao Xue, Beijing (CN); Shuaishuai Xu, Beijing (CN); Lingyun Shi, Beijing (CN); Wei Sun, Beijing (CN); Guangquan Wang, Beijing (CN); Dong Chen, Beijing (CN); Xue Dong, Beijing (CN); Xiaochuan Chen, Beijing (CN)

(73) Assignees: BEIJING BOE OPTOELECTRONICS TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/091,962

(22) PCT Filed: Dec. 13, 2017

(86) PCT No.: PCT/CN2017/115976

§ 371 (c)(1),
(2) Date: Oct. 5, 2018

(87) PCT Pub. No.: WO2018/126861

PCT Pub. Date: Jul. 12, 2018

(65) Prior Publication Data

US 2019/0122601 A1 Apr. 25, 2019

(30) Foreign Application Priority Data

Jan. 4, 2017 (CN) ..... 2017 1 0003393

(51) Int. Cl.
*G09G 3/20* (2006.01)
*G09G 3/36* (2006.01)

(52) U.S. Cl.
CPC ..... *G09G 3/2007* (2013.01); *G09G 3/3611* (2013.01); *G09G 3/3696* (2013.01); *G09G 2320/0666* (2013.01); *G09G 2330/021* (2013.01); *G09G 2340/0428* (2013.01); *G09G 2350/00* (2013.01)

(58) Field of Classification Search
CPC ..... G09G 3/2007; G09G 3/3696; G09G 2320/0666; G09G 2330/021
See application file for complete search history.

(56) References Cited

U.S. PATENT DOCUMENTS 7,423,383 B2 9/2008 Kawano
7,501,771 B2 3/2009 Kawano
(Continued)

FOREIGN PATENT DOCUMENTS

CN 1510950 A 7/2004
CN 1295939 C 1/2007
(Continued)

OTHER PUBLICATIONS

International Search Report and Written Opinion dated Mar. 23, 2018, for application No. PCT/CN2017/115976.
(Continued)

*Primary Examiner* — Lisa S Landis
(74) *Attorney, Agent, or Firm* — Foley & Lardner LLP

(57) ABSTRACT

The present disclosure relates to a driving circuit for a display screen, a display method and a display device, which belong to the display technical field. The driving circuit for a display screen includes an analyzer configured to analyze
(Continued)

and determine at least one of a current working mode of the display screen and a picture parameter of a to-be-displayed picture which is to be displayed on the display screen. The driving circuit includes a processor configured to determine a color depth bit value of the to-be-displayed picture of the display screen according to the at least one of the current working mode of the display screen and the picture parameter of the to-be-displayed picture which is to be displayed on the display screen.

9 Claims, 6 Drawing Sheets

(56) References Cited

U.S. PATENT DOCUMENTS

| | | | | |
|---|---|---|---|---|
| 2002/0000994 | A1* | 1/2002 | Bergstrom ..... | G09G 3/2062 345/605 |
| 2002/0047590 | A1 | 4/2002 | Kawano | |
| 2004/0104886 | A1 | 6/2004 | Kawano | |
| 2004/0104919 | A1 | 6/2004 | Kawano | |
| 2004/0104922 | A1 | 6/2004 | Kawano | |

FOREIGN PATENT DOCUMENTS

| | | | | |
|---|---|---|---|---|
| CN | 101256751 | A | | 9/2008 |
| CN | 100594537 | C | | 3/2010 |
| CN | 102075628 | A | | 5/2011 |
| CN | 104409019 | A | | 3/2015 |
| CN | 105096877 | A | | 11/2015 |
| CN | 105554587 | | * | 5/2016 |
| CN | 105554587 | A | | 5/2016 |
| CN | 106486081 | A | | 3/2017 |
| CN | 106652955 | A | | 5/2017 |
| CN | 105096877 | B | | 6/2017 |

OTHER PUBLICATIONS

Chinese Office Action dated May 17, 2019, from application No. 201710003393.5.

* cited by examiner

DRIVING CIRCUIT FOR DISPLAY SCREEN WITH ADJUSTABLE COLOR DEPTH BIT VALUE, DISPLAY METHOD AND DISPLAY DEVICE

CROSS REFERENCE

The present application is based upon International Application No. PCT/CN2017/115976, filed on Dec. 13, 2017, which is based upon and claims priority to Chinese Patent Application No. 201710003393.5, filed on Jan. 4, 2017, and the entire contents thereof are incorporated herein by reference.

TECHNICAL FIELD

The present disclosure relates to display technologies, and particularly to a driving circuit for a display screen, a display method and a display device.

BACKGROUND

The color display capability of a liquid crystal display device is generally described by the number of bits of grayscales which the liquid crystal display device can display on each color channel. For example, if the liquid crystal display device can display 256 ($2^8$) grayscales on each color channel, it is called a 8-bit liquid crystal display device; if it can display 64 ($2^6$) grayscales on each color channel, it is called a 6-bit liquid crystal display device; if it can display 8 ($2^3$) grayscales on each color channel, it is called a 3-bit liquid crystal display device.

The high bit color depth supports more fine color resolution, which makes the color performance better. From the perspective of the picture display effect, the liquid crystal display device with high bit color depth can make the color transition smoother, and the color is richer and more vivid. The higher the bit value is, the better the color transition will be.

It should be noted that, information disclosed in the above background portion is provided only for better understanding of the background of the present disclosure, and thus it may contain information that does not form the prior art known by those ordinary skilled in the art.

SUMMARY

The present disclosure provides a driving circuit for a display screen, a display method and a display device.

Arrangements of the present disclosure provide the following technical solutions.

According to a first aspect, there is provided a driving circuit for a display screen. The driving circuit includes an analyzer configured to analyze and determine at least one of a current working mode of the display screen and a picture parameter of a to-be-displayed picture which is to be displayed on the display screen. The driving circuit includes a processor configured to determine a color depth bit value of the to-be-displayed picture of the display screen according to the at least one of the current working mode of the display screen and the picture parameter of the to-be-displayed picture which is to be displayed on the display screen.

An arrangement of the present disclosure provides a display device. The display device includes a display screen and the driving circuit for the display screen as described.

Further, a substrate of the display screen is a silicon substrate, and a processing circuit of the display screen is integrated in the silicon substrate.

An arrangement of the present disclosure provides a display method for a display screen. The method includes analyzing and determining at least one of a current working mode of the display screen and a picture parameter of a to-be-displayed picture which is to be displayed on the display screen. The method includes determining a color depth bit value of the to-be-displayed picture of the display screen according to the at least one of the current working mode of the display screen and the picture parameter of the to-be-displayed picture which is to be displayed on the display screen.

It is to be understood that both the foregoing general description and the following detailed description are exemplary and explanatory only and are not restrictive of the disclosure, as claimed.

This section provides a summary of various implementations or examples of the technology described in the disclosure, and is not a comprehensive disclosure of the full scope or all features of the disclosed technology.

DETAILED DESCRIPTION

To make the technical problems, the technical solutions, and the advantages of the arrangements of the present disclosure clearer, the present disclosure will be described in detail below with reference to drawings and arrangements.

Aiming at the problem in prior arts that the display quality of display devices and reduction of the power consumption of the display devices cannot be both ensured, arrangements of the present disclosure provide a driving circuit for a display screen, a display method, and a display device, which can reduce the power consumption of the display device while ensuring the display quality of the displayed pictures.

Figure 1:
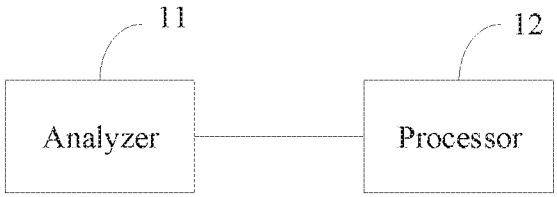
FIG. 1 is a schematic structural diagram of a driving circuit for a display screen according to an arrangement of the present disclosure.

One arrangement of the present disclosure provides a driving circuit for a display screen. As shown in FIG. 1, the driving circuit includes an analyzer 11 and a processor 12.

The analyzer 11 is configured to analyze and determine a current working mode of the display screen and/or analyze and determine a picture parameter of a to-be-displayed picture which is to be displayed on the display screen.

The processor 12 is configured to determine a color depth bit value of the to-be-displayed picture of the display screen according to the current working mode of the display screen and/or the picture parameter of the to-be-displayed picture which is to be displayed on the display screen.

In this arrangement, the current working mode of the display screen is analyzed by the analyzer to obtain the analysis result regarding which working mode the display screen is in, and then, according to the current working mode of the display screen in conjunction with the picture parameter of the to-be-displayed picture which is to be displayed on the display screen, the color depth bit value of the to-be-displayed picture is determined. When the display screen is in a normal working mode, the display screen is controlled to display pictures with a relatively high color bit value; when the display screen is in an energy-saving working mode, the display screen is controlled to display pictures with a relatively low color bit value; when the display screen is in a smart working mode, local regions of the to-be-displayed picture on the display screen are displayed with a relatively high color depth bit value, and other regions are displayed with a relatively low color depth value. In this way, the power consumption of the display device can be reduced while not influencing user experiences. Further, the processor is configured to, when the display screen is in the first working mode, control the color depth bit value of the to-be-displayed picture of the display screen to be a first color depth bit value, and when the display screen is in the second working mode, control the color depth bit value of the to-be-displayed picture of the display screen to be a second color depth bit value.

In the arrangement, the power consumption when the display screen is in the first working mode is greater than power consumption when the display screen is in the second working mode, and the first color depth bit value is greater than the second color depth bit value Through the technical solution of the arrangement, when the power consumption of the display screen is required to be relatively small, for example, when the display screen is in the energy-saving working mode, the display screen can be controlled to display with a relatively low color depth bit value such as 3-bit. When the power consumption of the display screen is not required to be relatively small but the display quality of the display screen is required to be good, for example, when the display screen is in the normal working mode, the display screen can be controlled to display with a relatively high color depth bit value such as 8-bit.

Figure 2:
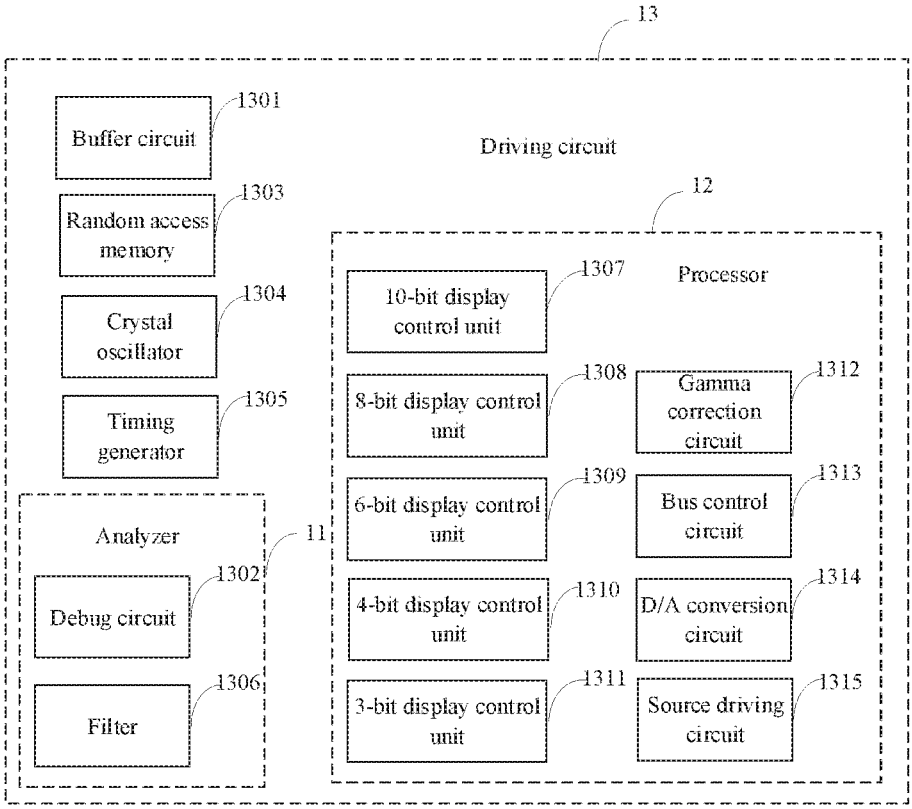
FIG. 2 is a circuit diagram of a driving circuit for a display screen according to an arrangement of the present disclosure.

FIG. 2 is a circuit diagram of a driving circuit for a display screen according to an arrangement of the present disclosure. The driving circuit includes display control units for performing preprocessing and filtering on the image data of the to-be-displayed picture, allocating the image data of the to-be-displayed picture to a display control unit having a corresponding bit processing capability, and conversion and output portions. It should be noted that, for the image data of the to-be-displayed picture, it is also required to use a GPU (Graphics Processing Unit) to process the image data into a data format recognizable by the display screen, and then the processed data is transmitted to the driving circuit.

As shown in FIG. 2, the driving circuit 13 includes a buffer circuit 1301, a debug circuit 1302, a random access memory (RAM) 1303, a crystal oscillator (SOC) 1304, a timing generator 1305, a filter 1306, a 10-bit display control unit 1307, a 8-bit display control unit 1308, a 6-bit display control unit 1309, a 4-bit display control unit 1310, a 3-bit display control unit 1311, a gamma correction circuit 1312, a bus control circuit 1313, a D/A conversion circuit 1314, a source driving circuit 1315, and the like. The buffer circuit 1301, the debug circuit 1302, the random access memory (RAM) 1303, the crystal oscillator (SOC) 1304, and the timing generator 1305 belong to the preprocessing portion for performing preprocesses, such as receiving image data of the to-be-displayed picture and buffering the data, and performing serialization using clock signals. The image data is buffered and preprocessed using a clock signal for timing. The gamma correction circuit 1312, the bus control circuit 1313, the D/A conversion circuit 1314, and the source driving circuit 1315 belong to a conversion and output portion for performing a series of conversion processes such as gamma correction, digital-to-analog (D/A) conversion, and finally outputting and displaying the image data. Detailed descriptions are omitted here.

The debug circuit 1302 belongs to the analyzer 11 and is configured to analyze and determine whether the current working mode of the display screen is a first working mode or a second working mode. The processor 12 includes a plurality of display control units configured to process the input image information into image data having a corresponding color depth bit value, such as the 10-bit display control unit 1307, the 8-bit display control unit 1308, a the-bit display control unit 1309, the 4-bit display control unit 1310, and the 3-bit display control unit 1311 and the like. The display control units have different bit processing capabilities. For example, the 10-bit display control unit 1307 can process image data having a color depth bit value of 10-bit, and the 8-bit display control unit 1308 can process image data having a color depth bit value of 8-bit, 6-bit display control unit 1309 can process image data having a color depth bit value of 6-bit, the 4 bit display control unit 1310 can process image data having a color depth bit value of 4-bit, and the 3 bit display control unit 1311 can process image data having a color depth bit value of 3-bit, and so on. More display control units having corresponding color depth bit value processing capabilities may also be included in the processor 12, depending on the particular needs.

Figure 3:
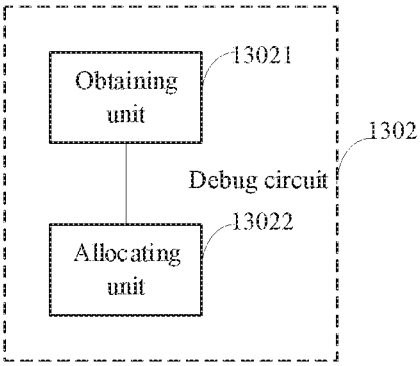
FIG. 3 is a schematic structural diagram of a debug circuit according to an arrangement of the present disclosure.

In another arrangement of the present disclosure, FIG. 3 shows a schematic structural diagram of a debug circuit. As shown in FIG. 3, the debug circuit 1302 includes an obtaining unit 13021 and an allocating unit 13022.

The obtaining unit 13021 is configured to obtain scene information of the to-be-displayed picture.

The allocating unit 13022 is configured to output the to-be-displayed picture to a corresponding display control unit according to the scene information.

In a specific implementation, the working mode of the display screen is first analyzed by the analyzer 11. If the display screen is in the smart working mode, the image data of the screen to be displayed is also pre-processed and filtered by the display control units. The obtaining unit 13021 in the debug circuit 1302 obtains scene information of the to-be-displayed picture. The scene information may include, for example, a lock screen scene, a game scene, a competition scene, a read scene, and the like. The to-be-displayed picture can be divided into different regions to display different regions with different color depth bit values, depending on scenes.

For example, for a game scene which involves bright colors, pictures or images can be displayed with a relatively high color depth bit value. For a scene which involves smooth color transition such as a lock screen scene, pictures or images can be displayed with a relatively low color depth bit value. Further, the allocating unit 13022 determines an (image) color depth bit value corresponding to the scene according to the scene information, and determines which display control unit performs the processing.

For example, in the process of controlling the output of the image data having the color depth bit value corresponding to the scene information according to the scene information, if it is a special scene such as a lock screen scene, the to-be-displayed picture is displayed with a much low color depth bit value (for example, a color depth bit value lower than 3-bit); if it is a special scene such as a game scene or a competition scene, in order to satisfy the viewing effect, the to-be-displayed picture is displayed with a high color depth bit value (for example, 10-bit); if it is a scene such as read scene, the to-be-displayed picture is displayed with a middle color depth bit value (such as 8-bit, 6-bit, 4-bit or other bit value). In this way, the viewing effect can be met and meanwhile the power consumption can be reduced. Finally, the processed image data is output to the display screen through the conversion and output portion for display.

According to the technical solution of the arrangement, the scene information of the to-be-displayed picture can be displayed with a corresponding color depth bit value, and the display mode conforming to the scene requirement can be provided, which can satisfy the viewing effect in the scene with high display effect requirement and can save power consumption in the scene where the display effect is not high.

As shown in FIG. 2, in another arrangement of the present disclosure, the analyzer 11 may further include a filter 1306 for processing the pre-processed image data according to requirements to divide the to-be-displayed picture into a plurality of picture units. For each picture unit, the image data is transmitted to a corresponding display control unit in the processor for display control according to the determined color depth bit value.

Figure 4:
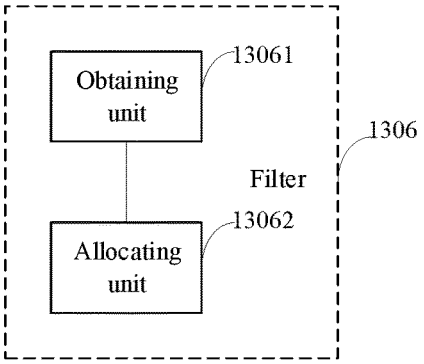
FIG. 4 is a schematic structural view of a filter according to an arrangement of the present disclosure.

Further, in another arrangement of the present disclosure, FIG. 4 shows a schematic structural diagram of a filter. As shown in FIG. 4, the filter 1306 includes an obtaining unit 13061 and an allocating unit 13062.

The obtaining unit 13061 is configured to obtain a grayscale change value of each picture unit of the to-be-displayed picture. The grayscale change value is a difference between a grayscale value of a pixel with the largest grayscale in the picture unit and a grayscale value of a pixel with the smallest grayscale in the picture unit.

The allocating unit 13062 is configured to, when the grayscale change value of a first picture unit is greater than a first preset threshold value, allocate the first picture unit to a first display control unit, and when the grayscale change value of a second picture unit is not greater than the first preset threshold value, allocate the second picture unit to a second display control unit. The first display control unit is construed to output the first picture unit to be image data having the first color depth bit value, the second display control unit is construed to output the second picture unit to be image data having the second color depth bit value, and the second color depth bit value is smaller than the first color depth bit value. The first preset threshold value can be set according to actual requirements.

With the technical solution of the arrangement, it is possible to display with a relatively high color depth bit value such as 8-bit in a local area where the color of the picture to be displayed on the display screen is relatively bright, or to display with a relatively low color depth bit value such as 3-bit in a local area where the color of the picture to be displayed on the display screen is relatively dim. In this way, the power consumption of the display device can be greatly reduced without affecting the user experience.

Of course, the technical solution of the present disclosure is not limited to displaying with only two different color depth bit values on the display screen, and the picture to be displayed on the screen may be divided into three or more picture units, and the picture units can be displayed with different color depth bit values. For example, the display screen can be divided into three or more ring-shaped picture units from inside to outside. And from the inside to the outside, the color depth bit value of the picture unit is gradually increased or decreased. The shape of the ring may be a circle, a square or any other shape. The form for dividing the to-be-displayed picture into picture units can be determined depending on specific needs, such as the examples as shown in FIGS. 5 to 7.

Figure 5:
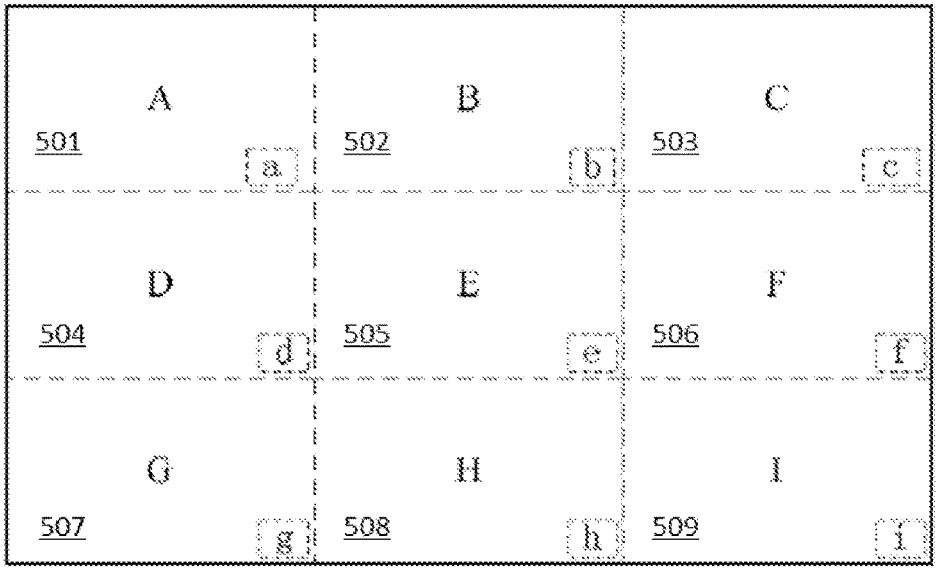
FIG. 5 is a schematic diagram which shows dividing a to-be-displayed picture on a display screen into picture units according to an arrangement of the present disclosure.

As shown in FIG. 5, the picture to be displayed on the display screen can be divided into multiple picture units: A (501), B (502), C (503), D (504), E (505), F (506), G (507), H (508), and I (509). That is, the picture to be displayed is divided into a plurality of picture units in a nine-square grid manner. As shown in FIG. 6, the picture to be displayed on screen is divided into a plurality of square ring picture units: H (601), I (602), J (603), K (604), and L (605). As shown in FIG. 7, the picture to be displayed on the display screen can also be divided into a plurality of circular ring picture units: M (701), N (702), O (703), P (704), and Q (705). The obtained picture units display image data of different color depth bit values no matter who the to-be-displayed picture is divided. Assuming that the ring division mode or manner shown in FIG. 6 or FIG. 7 is taken as an example, the color depth bit values of the ring picture units can be gradually reduced in the direction from the inside to the outside, such as: 10-bit, 8-bit, 6-bit, 4-bit, and 3-bit, and so on.

Figure 6:
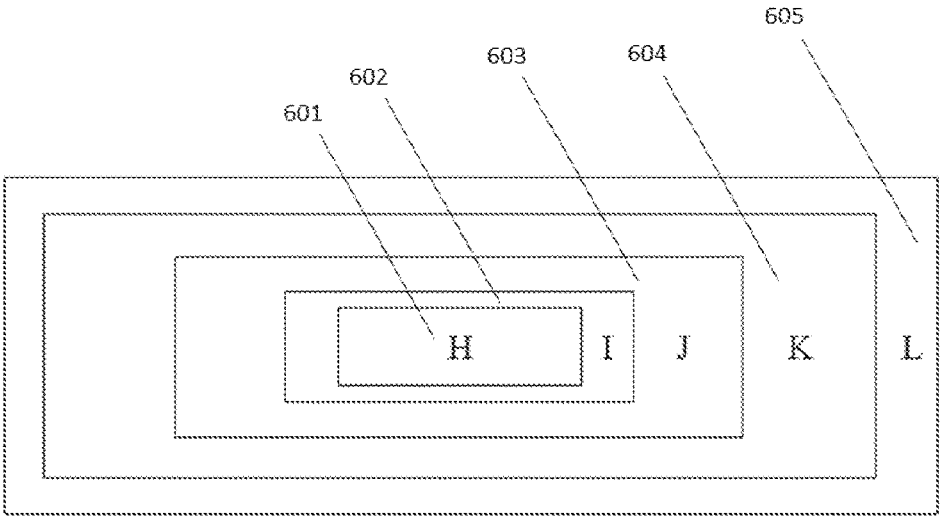
FIG. 6 is a schematic diagram which shows dividing a to-be-displayed picture on a display screen into picture units according to an arrangement of the present disclosure.
Figure 7:
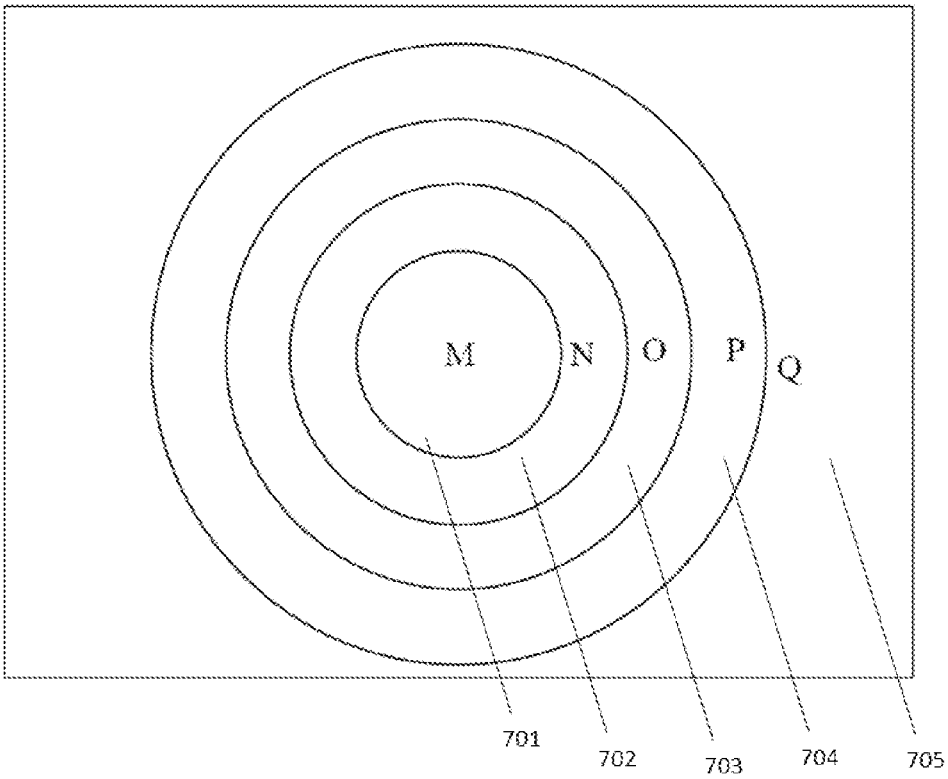
FIG. 7 is a schematic diagram which shows dividing a to-be-displayed picture on a display screen into picture units according to an arrangement of the present disclosure.

It should be noted that FIG. 5 to FIG. 7 are only several exemplary implementations for dividing the to-be-displayed picture into picture units, and in actual use, the division manner of the picture units may also be performed according to the specific requirements of the picture to be displayed, and not all manners are listed here.

Based on the above, in the arrangement, the working mode of the display screen is first analyzed by the analyzer 11. If the display screen is in the normal working mode or the energy-saving mode, the color depth bit value of the to-be-displayed picture on the display screen can be determined according to the working mode. If the display screen is in the smart working mode, the image data of the to-be-displayed picture needs to be pre-processed, filtered, and so on, and the to-be-displayed picture is divided into a plurality of picture units. Then, the picture parameters (such as the grayscale change values) of each picture unit in the picture to be displayed are acquired by the obtaining unit 13061 in the filter 1306. Next, the allocating unit 13062 determines which display control unit to process the data according to the comparison result between the picture parameters of each picture and preset threshold values. Then, the display control unit processes the picture unit, the conversion and output portion outputs the processed image data to the display screen for display.

Further, as shown in FIG. 4, the filter 1306 includes an obtaining unit 13061 and allocating unit 13062.

The obtaining unit 13061 is configured to obtain a resolution of each picture unit of the to-be-displayed picture.

The allocating unit 13062 is configured to, when the resolution of a first picture unit is greater than a second preset threshold value, allocate the first picture unit to a first display control unit, and when the resolution of a second picture unit is not greater than the second preset threshold value, allocate the second picture unit to a second display control unit. The first display control unit is construed to output the first picture unit to be image data having the first color depth bit value, the second display control unit is construed to output the second picture unit to be image data having the second color depth bit value, and the second color depth bit value is smaller than the first color depth bit value. The second preset threshold value can be set depending on actual needs.

The circuit and the circuit principle in this arrangement are the same as those in the foregoing arrangements, and are not described herein again.

With the technical solution of the arrangement, the local area of the high-definition picture displayed on the display screen can be displayed with a relatively high color depth bit value, such as 8-bit, or the local area of the low-definition picture displayed on the display screen can be displayed with a relatively low color depth bit value, such as 3-bit. In this way, the power consumption of the display device can be reduced while not affecting the user experience.

Figure 8:
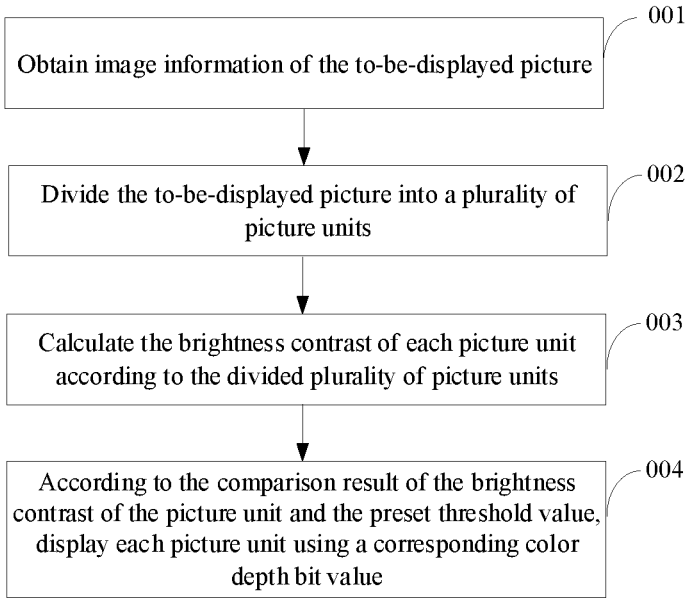
FIG. 8 is a schematic flowchart of a method for calculating a color depth bit value of a to-be-displayed picture according to an arrangement of the present disclosure.

Based on the above arrangements in which the to-be-displayed picture is divided into regions and different regions are displayed with corresponding color depth bit values, FIG. 8 shows a schematic flowchart of calculating the color depth bit value of the to-be-displayed picture. As shown in FIG. 8, the calculation may be performed by the following blocks.

In block 001, image information of the to-be-displayed picture is obtained. For example, H and V indicate the number of pixels of the to-be-displayed picture in the horizontal direction and the vertical direction, respectively, so that the to-be-displayed picture may be represented as H*V.

In block 002, the to-be-displayed picture is divided into a plurality of picture units, that is, performing image processing on the H*V to-be-displayed picture, and a plurality of picture units are obtained, which are represented by filter (h*v). According to the division manners of the picture units as described, the picture units represented by filter(h*v) are not all absolutely square, and may also be in the shape of a ring or the like.

In block 003, the brightness contrast of each picture unit is calculated according to the divided plurality of picture units. The calculation formula of the brightness contrast may be:

$$R=\max(h*v)/\min(h*v);$$

In block 004, according to the comparison result of the brightness contrast of the picture unit and the preset threshold value, each picture unit is displayed using a corresponding color depth bit value. The number of the preset threshold values may be one, two or more.

Assuming that the circular ring picture unit shown in FIG. 7 is taken as an example, the comparison result is: if the brightness contrast of the picture unit M is greater than the preset threshold value R1, the picture unit M is displayed with a 10-bit color depth bit value; if the brightness contrast of the picture N is greater than the preset threshold value R2, the picture unit N is displayed with a 8-bit color depth bit value; if the brightness contrast of the picture unit O is greater than the preset threshold value R3, the picture unit O is displayed with a 6-bit color depth bit value; if the brightness contrast of the picture unit P is greater than the preset threshold value R4, the picture unit P is displayed with a 4-bit color depth bit value; if the brightness contrast of the picture unit Q is less than or equal to the preset threshold value R4, the picture unit Q is displayed with a 3-bit color depth bit value. Finally, the image to be highlighted in the picture to be displayed is displayed with a high color depth bit value, and the background or general image in the picture to be displayed is displayed with a low color depth bit value.

Further, as shown in FIG. 4, the filter 1306 includes an obtaining unit 13061 and an allocating unit 13062.

The obtaining unit 13061 is configured to obtain a gaze center of the to-be-displayed picture.

The allocating unit 13062 is configured to allocate a first picture unit where the gaze center is to a first display control unit, and allocate a second picture unit which is outside the gaze center to a second display control unit. The first display control unit is construed to output the first picture unit to be image data having the first color depth bit value, the second display control unit is construed to output the second picture unit to be image data having the second color depth bit value, and the second color depth bit value is smaller than the first color depth bit value.

In a specific implementation, the obtaining unit 13061 obtains the gaze center based on the human eye tracking technology and may be implemented by using a pupil center corneal reflection (PCCR) technology. The principle of the PCCR technology is as follows: by capture of a camera of a physical tracking device, the light source illuminates the pupil to form highly visible reflected images. These images will be configured to determine the reflection of the light source in the cornea and pupil, and finally by the reflection of the cornea and pupil, the angle between the vectors is formed and other geometric features are calculated to obtain the direction in which the human eye is looking, that is, to obtain the gaze center.

Based on the above, in the arrangement, the working mode of the display screen is first analyzed by the analyzer. If the display screen is in the smart working mode, the image data of the to-be-displayed picture needs to be pre-processed, filtered, and the like. The obtaining unit 13061 in the filter 1306 tracks the human eye of the user through the human eye tracking device to acquire the gaze center, and roughly divides the to-be-displayed picture into two picture units according to the tracking result, that is, the first picture unit where the gaze center is and the second picture unit located outside the gaze center. Of course, a plurality of picture units can be added as a transition between the two picture units, so that the entire picture to be displayed is divided into at least two picture units. Further, the allocating unit 13062 determines which display unit to process the first and second picture units. Generally, the picture unit corresponding to the gaze center is processed by a display control unit with a relatively high color depth bit value, and the picture unit outside the gaze center is processed by a display control unit with a relatively low color bit value, and after the processing of the display control units, the conversion and output portion outputs the processed image data to the display screen for display.

According to the technical solution of the arrangement, the different areas of the picture to be displayed may be displayed with different color depth bit values according to the user's gaze center (i.e., focus of the user's eye). For example, an area of interest to the user (i.e., the picture unit corresponding to the gaze center) is displayed with a relatively high color depth bit value such as 8-bit, and a blind spot of the user's sight (that is, a picture unit outside the gaze center and picture units even out of the user's sight) is displayed with a relatively low color depth bit value, for example, 3-bit. In this way, the power consumption of the display device can be greatly reduced without affecting the user experience, and at the same time, the displayed picture is more layered and the user's visual experience is not affected.

One arrangement of the present disclosure provides a display device including a display screen and a driving circuit for the display screen as described above. The display device may be any product or component having a display function, such as a television, a display, a digital photo frame, a mobile phone, a tablet computer, and so on. The display device further includes a flexible circuit board, a printed circuit board, and a back plate.

Further, the substrate of the display screen is a silicon substrate, and a processing circuit of the display screen is integrated in the silicon substrate. Since the information storage capability of the silicon substrate is strong, the driving circuit of the display screen can be integrated in the silicon substrate, which simplifies the structure of the display device.

In a specific implementation, when the substrate of the display screen is a silicon substrate, the picture to be displayed on the display screen may be divided into a plurality of picture units, as shown in FIGS. 5-7. Taking the dividing manner of the picture units as shown in FIG. 5 as an example, the picture to be displayed is divided into a plurality of picture units of A to I, and the driving circuit for the display screen includes a display control unit, and the display control unit further includes a plurality of display control subunits a to i which are integrated in the silicon substrate of the display screen. The display control subunit a outputs image data according to the corresponding picture unit A, the display control subunit b outputs image data according to the corresponding picture unit B, the display control subunit c outputs image data according to the corresponding picture unit C, the display control subunit d outputs image data according to the corresponding picture unit D, the display control subunit e outputs image data according to the corresponding picture unit E, the display control subunit f outputs image data according to the corresponding picture unit F, the display control subunit g outputs image data according to the corresponding picture unit the display control subunit h outputs image data according to the corresponding picture unit H, and the display control subunit i outputs image data according to the corresponding picture unit H.

In a specific implementation, when the display screen displays the to-be-displayed picture, the scene information of to-be-displayed picture is obtained, and the image data having the color depth bit value corresponding to the scene information is output according to the scene information. In this way, the display conforms to the scene requirement is provided. The method can not only satisfy the viewing effect in a scene with high display effect requirements, but also reduce power consumption in a scene with low display effect requirements.

In a specific implementation, when the display screen displays the to-be-displayed picture, the grayscale change value of each screen unit of the to-be-displayed picture is obtained. When the grayscale change value of a picture unit is greater than the first preset threshold value, the display control unit corresponding to the picture unit can output image data with a color depth of 8 bits. When the grayscale change value of a picture unit is not greater than the first preset threshold value, the display control unit corresponding to the picture unit can output image data with a color depth of 3 bits. In this way, the power consumption of the display device can be reduced without affecting the user experience.

In another specific implementation, when the display screen displays the to-be-displayed picture, the resolution of each picture unit of the to-be-displayed picture is obtained. When the resolution of a picture unit is greater than the second preset threshold value, the display control unit corresponding to the picture unit can output image data with a color depth of 8 bits. When the resolution of a picture unit is not greater than the second preset threshold value, the display control unit corresponding to the picture unit can output image data with a color depth of 3 bits. In this way, the power consumption of the display device can be reduced without affecting the user experience.

In another specific implementation, when the display screen displays the to-be-displayed picture, a first picture unit where the gaze center is is allocated to a first display control unit, and a second picture unit which is outside the gaze center is allocated to a second display control unit. The first display control unit is construed to output the first picture unit to be image data having the first color depth bit value, the second display control unit is construed to output the second picture unit to be image data having the second color depth bit value, and the second color depth bit value is smaller than the first color depth bit value. In this way, according to the focus of the user's sight, the different areas of the to-be-displayed picture are displayed with different color depth bit values. For example, the area of interest to the user (that is, the picture unit corresponding to the gaze center of the human eye) is displayed with a relatively high color depth bit value, for example, 8-bit, and a blind spot of the user's sight (that is, a picture unit outside the gaze center and picture units even out of the user's sight) is displayed with a relatively low color depth bit value, for example, 3-bit. In this way, the power consumption of the display device can be greatly reduced without affecting the user experience, and at the same time, the displayed picture is more layered and the user's visual experience is not affected.

Figure 9:
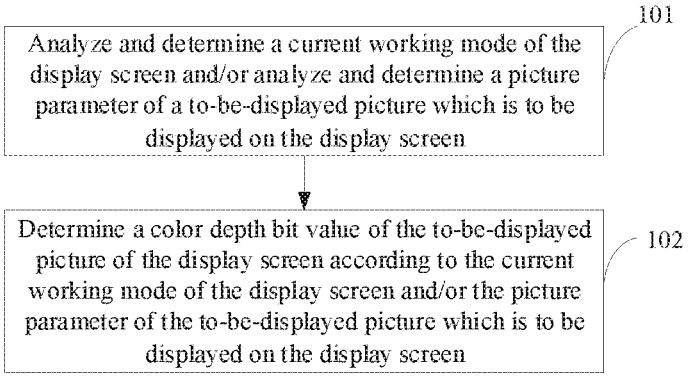
FIG. 9 is a schematic flowchart of a display method for a display screen according to an arrangement of the present disclosure.

One arrangement of the present disclosure provides a display method for a display screen. As shown in FIG. 9, the method includes the following blocks.

In block 101, a current working mode of the display screen is analyzed and determined, and/or a picture parameter of a to-be-displayed picture which is to be displayed on the display screen is analyzed and determined.

In block 102, a color depth bit value of the to-be-displayed picture of the display screen is determined according to the current working mode of the display screen and/or the picture parameter of the to-be-displayed picture which is to be displayed on the display screen.

In the arrangement, a color depth bit value of the to-be-displayed picture is determined according to the current working mode of the display screen in conjunction with the picture parameter of the to-be-displayed picture which is to be displayed on the display screen. When the display screen is in a normal working mode, the display screen is controlled to display pictures with a relatively high color bit value; when the display screen is in an energy-saving working mode, the display screen is controlled to display pictures with a relatively low color bit value; when the display screen is in a smart working mode, local regions of the to-be-displayed picture on the display screen are displayed with a relatively high color depth bit value, and other regions are displayed with a relatively low color depth value. In this way, the power consumption of the display device can be greatly reduced while not influencing user experiences.

Further, block 101 includes analyzing and determining whether the current working mode of the display screen is a first working mode or a second working mode.

Further, block 102 includes when the display screen is in the first working mode, controlling the color depth bit value of the to-be-displayed picture of the display screen to be a first color depth bit value. When the display screen is in the second working mode, block 102 include controlling the color depth bit value of the to-be-displayed picture of the display screen to be a second color depth bit value.

Power consumption when the display screen is in the first working mode is greater than power consumption when the display screen is in the second working mode, and the first color depth bit value is greater than the second color depth bit value.

Through the technical solution of the arrangement, when the power consumption of the display screen is required to be relatively small, for example, when the display screen is in the energy-saving working mode, the display screen can be controlled to display with a relatively low color depth bit value such as 3-bit. When the power consumption of the display screen is not required to be relatively small but the display quality of the display screen is required to be good, for example, when the display screen is in the normal working mode, the display screen can be controlled to display with a relatively high color depth bit value such as 8-bit.

Further, the picture which is to be displayed on the display screen is divided into a plurality of picture units. The processor includes a plurality of display control units configured to process the input image information into image data having corresponding color depth bit values.

In some arrangements of the present disclosure, before the processing the input image information into the image data having the corresponding color depth bit value, the method further includes:

dividing the to-be-displayed picture into a plurality of picture units according to the picture parameter of to-be-displayed picture.

Figure 10:
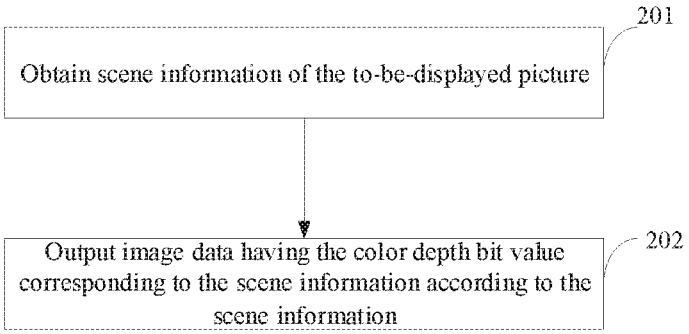
FIG. 10 is a schematic flowchart of processing input image information into image data having corresponding color depth bit values according to an arrangement of the present disclosure.

Further, as shown in FIG. 10, processing input image information into image data having a corresponding color depth bit value includes:

In block 201, scene information of the to-be-displayed picture is obtained.

In block 202, image data having the color depth bit value corresponding to the scene information is output according to the scene information.

According to the technical solution of the arrangement, the scene information of the to-be-displayed picture can be displayed with a corresponding color depth bit value, and the display mode conforming to the scene requirement can be provided, which can satisfy the viewing effect in the scene with high display effect requirement and can save power consumption in the scene where the display effect is not high.

Figure 11:
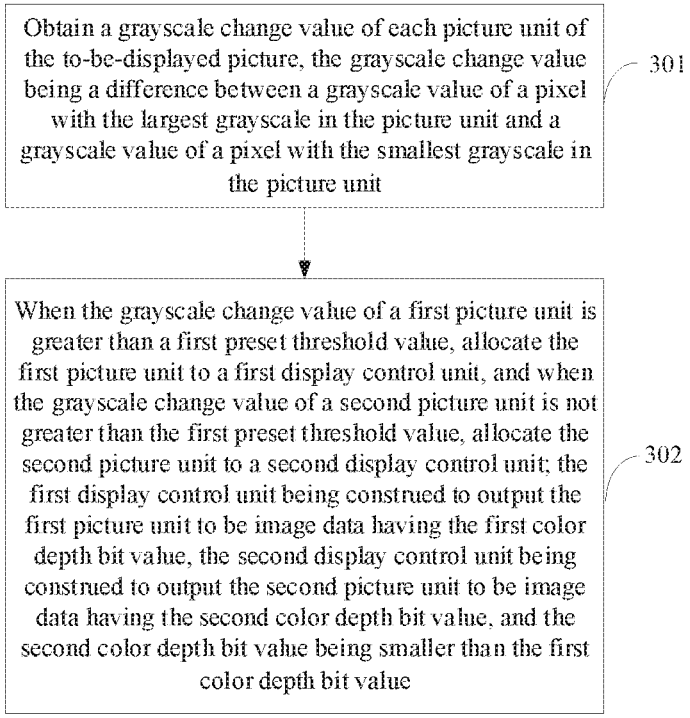
FIG. 11 is a schematic flowchart of processing input image information into image data having corresponding color depth bit values according to an arrangement of the present disclosure.

Further, as shown in FIG. 11, processing input image information into image data having a corresponding color depth bit value, includes the following blocks.

In block 301, a grayscale change value of each picture unit of the to-be-displayed picture is obtained. The grayscale change value is a difference between a grayscale value of a pixel with the largest grayscale in the picture unit and a grayscale value of a pixel with the smallest grayscale in the picture unit.

In block 302, when the grayscale change value of a first picture unit is greater than a first preset threshold value, the first picture unit is allocated to a first display control unit. When the grayscale change value of a second picture unit is not greater than the first preset threshold value, the second picture unit is allocated to a second display control unit. The first display control unit is construed to output the first picture unit to be image data having the first color depth bit value. The second display control unit is construed to output the second picture unit to be image data having the second color depth bit value. The second color depth bit value is smaller than the first color depth bit value.

With the technical solution of the arrangement, it is possible to display with a relatively high color depth bit value such as 8-bit in a local area where the color of the picture to be displayed on the display screen is relatively bright, or to display with a relatively low color depth bit value such as 3-bit in a local area where the color of the picture to be displayed on the display screen is relatively dim. In this way, the power consumption of the display device can be greatly reduced without affecting the user experience.

Figure 12:
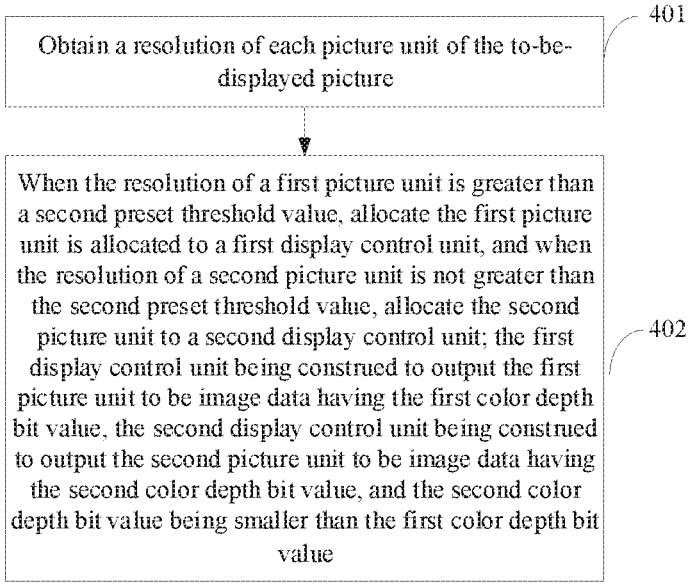
FIG. 12 is a schematic flowchart of processing input image information into image data having corresponding color depth bit values according to an arrangement of the present disclosure.

Further, as shown in FIG. 12, processing input image information into image data having a corresponding color depth bit value includes the following blocks.

In block 401, a resolution of each picture unit of the to-be-displayed picture is obtained.

In block 402, when the resolution of a first picture unit is greater than a second preset threshold value, the first picture unit is allocated to a first display control unit, and when the resolution of a second picture unit is not greater than the second preset threshold value, the second picture unit is allocated to a second display control unit. The first display control unit is construed to output the first picture unit to be image data having the first color depth bit value, the second display control unit is construed to output the second picture unit to be image data having the second color depth bit value, and the second color depth bit value is smaller than the first color depth bit value.

With the technical solution of the arrangement, the local area of the high-definition picture displayed on the display screen can be displayed with a relatively high color depth bit value, such as 8-bit, or the local area of the low-definition picture displayed on the display screen can be displayed with a relatively low color depth bit value, such as 3-bit. In this way, the power consumption of the display device can be reduced while not affecting the user experience.

Figure 13:
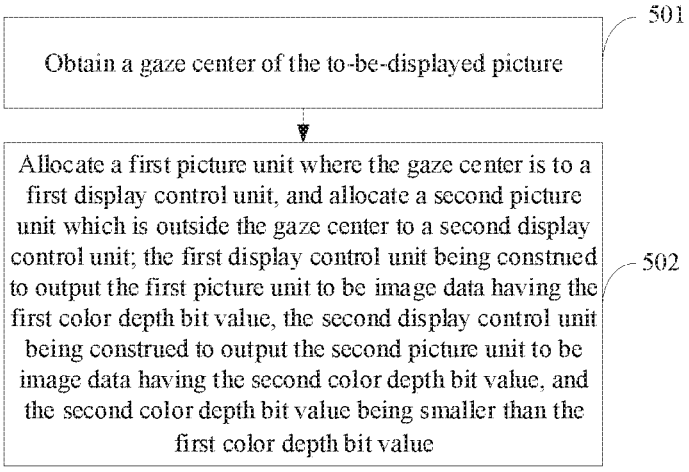
FIG. 13 is a schematic flowchart of processing input image information into image data having corresponding color depth bit values according to an arrangement of the present disclosure.

Further, as shown in FIG. 13, processing input image information into image data having a corresponding color depth bit value includes the following blocks.

In block 501, a gaze center of the to-be-displayed picture is obtained.

In block 502, a first picture unit where the gaze center is is allocated to a first display control unit, and a second picture unit which is outside the gaze center is allocated to a second display control unit. The first display control unit is construed to output the first picture unit to be image data having the first color depth bit value, the second display control unit is construed to output the second picture unit to be image data having the second color depth bit value, and the second color depth bit value is smaller than the first color depth bit value.

According to the technical solution of the arrangement, the different areas of the picture to be displayed may be displayed with different color depth bit values according to focus of the user's sight. For example, an area of interest to the user (i.e., the picture unit corresponding to the gaze center) is displayed with a relatively high color depth bit value such as 8-bit, and a blind spot of the user's sight (that is, a picture unit outside the gaze center and picture units even out of the user's sight) is displayed with a relatively low color depth bit value, for example, 3-bit. In this way, the power consumption of the display device can be greatly reduced without affecting the user experience, and at the same time, the displayed picture is more layered and the user's visual experience is not affected.

Many of the functional components described in this specification are referred to as modules to more particularly emphasize the independence of their implementations.

In arrangements of the present disclosure, modules may be implemented in software to be executed by various types of processors. For example, an identified executable code module can include one or more physical or logical blocks of computer instructions, which can be constructed, for example, as an object, procedure, or function. Nonetheless, the executable codes of the identified modules need not be physically located together, but may include different instructions stored in different physical entities. When logically combined, the instructions constitute a module and achieve the specified purpose of the module.

In fact, the executable code module can be a single instruction or a number of instructions, and can even be distributed across multiple different code segments, distributed among different programs, and distributed across multiple storage devices. As such, operational data may be identified within the modules and may be implemented in any suitable form and organized within any suitable type of data structure. The operational data may be collected as a single data set, or may be distributed at different locations (including being distributed on different storage devices), and may at least partially exist as an electronic signal on a system or network.

When the module is implemented by software, considering the level of the existing hardware process, the function of the module which can be implemented in software can be achieved by technicians through constructing corresponding hardware circuits without considering the cost. The hardware circuit includes conventional Very Large Scale Integration (VLSI) circuits or gate arrays as well as existing semiconductors such as logic chips, transistors, or other discrete components. Modules can also be implemented with programmable hardware devices such as field programmable gate arrays, programmable array logic, programmable logic devices, and the like.

In the method arrangements of the present disclosure, the sequence numbers of the blocks are not used to limit the sequence or order of the blocks. For those skilled in the art, the changes of the order of the blocks without creative work also fall within the scope of the present disclosure.

The above are exemplary arrangements of the present disclosure. It should be noted that those skilled in the art can also make several improvements and modifications without departing from the principles of the present disclosure, and such improvements and modifications should be considered as fall within the scope of the present disclosure.

What is claimed is:

1. A driving circuit for a display screen, wherein the driving circuit comprises:

an analyzer configured to analyze and determine at least one of a current working mode of the display screen or a picture parameter of a to-be-displayed picture which is to be displayed on the display screen; and a processor configured to determine a color depth bit value of the to-be-displayed picture of the display screen according to the at least one of the current working mode of the display screen or the picture parameter of the to-be-displayed picture which is to be displayed on the display screen, wherein the analyzer comprises a debug circuit configured to analyze and determine whether the current working mode of the display screen is a first working mode or a second working mode;

the processor is configured to, when the display screen is in the first working mode, control the color depth bit value of the to-be-displayed picture of the display screen to be a first color depth bit value, and when the display screen is in the second working mode, control the color depth bit value of the to-be-displayed picture of the display screen to be a second color depth bit value;

power consumption when the display screen is in the first working mode is greater than power consumption when the display screen is in the second working mode, and the first color depth bit value is greater than the second color depth bit value;

the analyzer comprises a filter configured to divide the to-be-displayed picture into a plurality of picture units according to the picture parameter of to-be-displayed picture;

the processor comprises a plurality of display control units configured to process input image information into image data having a corresponding color depth bit value, and wherein the filter comprises an obtaining unit and an allocating unit, and wherein at least one of:

(a) the obtaining unit is configured to obtain a grayscale change value of each picture unit of the to-be-displayed picture, the grayscale change value being a difference between a grayscale value of a pixel with a largest grayscale in the picture unit and a grayscale value of a pixel with a smallest grayscale in the picture unit, and the allocating unit is configured to, in response to determining that the grayscale change value of a first picture unit is greater than a first preset threshold value, allocate the first picture unit to a first display control unit, and in response to determining that the grayscale change value of a second picture unit is not greater than the first preset threshold value, allocate the second picture unit to a second display control unit, the first display control unit outputs the first picture unit comprising image data having the first color depth bit value, the second display control unit outputs the second picture unit comprising image data having the second color depth bit value, and the second color depth bit value being smaller than the first color depth bit value;

(b) the obtaining unit is configured to obtain a gaze center of the to-be-displayed picture, and the allocating unit is configured to allocate a first picture unit where the gaze center is to a first display control unit, and allocate a second picture unit which is outside the gaze center to a second display control unit, the first display control unit outputs the first picture unit comprising image data having the first color depth bit value, the second display control unit outputs the second picture unit comprising image data having the second color depth bit value, and the second color depth bit value being smaller than the first color depth bit value; or (c) the obtaining unit is configured to obtain a brightness contrast of each picture unit of the to-be-displayed picture, and the allocation unit, in response to determining that the brightness contrast of a first picture unit is greater than a second preset threshold value, is configured to allocate the first picture unit to a first display control unit, and in response to determining that the brightness contrast of a second picture unit is not greater than the second preset threshold value, is configured to allocate the second picture unit to a second display control unit, the first display control unit outputs the first picture unit comprising image data having the first color depth bit value, the second display control unit outputs the second picture unit comprising image data having the second color depth bit value, and the second color depth bit value is smaller than the first color depth bit value.

2. The driving circuit for a display screen according to claim 1, wherein:

the processor comprises a plurality of display control units configured to process input image information into image data having a corresponding color depth bit value;

the debug circuit comprises:

an obtaining unit configured to obtain scene information of the to-be-displayed picture; and an allocating unit configured to output the to-be-displayed picture to a corresponding display control unit according to the scene information.

3. The driving circuit for a display screen according to claim 1, wherein the filter comprises:

an obtaining unit configured to obtain a resolution of each picture unit of the to-be-displayed picture; and an allocating unit configured to, when the resolution of a first picture unit is greater than a third preset threshold value, allocate the first picture unit to a first display control unit, and when the resolution of a second picture unit is not greater than the third preset threshold value, allocate the second picture unit to a second display control unit, wherein the first display control unit outputs the first picture unit comprising image data having the first color depth bit value, the second display control unit outputs the second picture unit comprising image data having the second color depth bit value, and the second color depth bit value is smaller than the first color depth bit value.

4. A display device comprising a display screen and the driving circuit for the display screen according to claim 1.

5. The display device according to claim 4, wherein a substrate of the display screen is a silicon substrate, and a processing circuit of the display screen is integrated in the silicon substrate.

6. A display method for a display screen, comprising:

analyzing and determining at least one of a current working mode of the display screen or a picture parameter of a to-be-displayed picture which is to be displayed on the display screen; and determining a color depth bit value of the to-be-displayed picture of the display screen according to the at least one of the current working mode of the display screen or the picture parameter of the to-be-displayed picture which is to be displayed on the display screen, wherein analyzing and determining the current working mode of the display screen comprises:

analyzing and determining whether the current working mode of the display screen is a first working mode or a second working mode;

determining a color depth bit value of the to-be-displayed picture of the display screen according to the current working mode of the display screen comprises:

when the display screen is in the first working mode, controlling the color depth bit value of the to-be-displayed picture of the display screen to be a first color depth bit value, and when the display screen is in the second working mode, controlling the color depth bit value of the to-be-displayed picture of the display screen to be a second color depth bit value;

wherein power consumption when the display screen is in the first working mode is greater than power consumption when the display screen is in the second working mode, and the first color depth bit value is greater than the second color depth bit value, wherein a processor comprises a plurality of display control units configured to process input image information into image data having a corresponding color depth bit value;

wherein determining a color depth bit value of the to-be-displayed picture of the display screen according to the picture parameter of the to-be-displayed picture which is to be displayed on the display screen comprises:

obtaining scene information of the to-be-displayed picture;

outputting the to-be-displayed picture to a corresponding display control unit according to the scene information, before processing the input image information into the image data having the corresponding color depth bit value, dividing the to-be-displayed picture into a plurality of picture units according to the picture parameter of to-be-displayed picture, and wherein processing the input image information into the image data having the corresponding color depth bit value further comprises one of:

obtaining a grayscale change value of each picture unit of the to-be-displayed picture, wherein the grayscale change value is a difference between a grayscale value of a pixel with a largest grayscale in the picture unit and a grayscale value of a pixel with a smallest grayscale in the picture unit; and in response to determining that the grayscale change value of a first picture unit is greater than a first preset threshold value, allocating the first picture unit to a first display control unit, and in in response to determining that the grayscale change value of a second picture unit is not greater than the first preset threshold value, allocating the second picture unit to a second display control unit, wherein the first display control unit outputs the first picture unit comprising image data having the first color depth bit value, the second display control unit outputs the second picture unit comprising image data having the second color depth bit value, and the second color depth bit value is smaller than the first color depth bit value;

obtaining a gaze center of the to-be-displayed picture; and allocating a first picture unit where the gaze center is to a first display control unit, and allocating a second picture unit which is outside the gaze center to a second display control unit, wherein the first display control unit outputs the first picture unit comprising image data having the first color depth bit value, the second display control unit outputs the second picture unit comprising image data having the second color depth bit value, and the second color depth bit value is smaller than the first color depth bit value; or obtaining a brightness contrast of each picture unit of the to-be-displayed picture; and when the brightness contrast of a first picture unit is greater than a third preset threshold value, allocating the first picture unit to a first display control unit, and when the brightness contrast of a second picture unit is not greater than the third preset threshold value, allocating the second picture unit to a second display control unit, wherein the first display control unit outputs the first picture unit comprising image data having the first color depth bit value, the second display control unit outputs the second picture unit comprising image data having the second color depth bit value, and the second color depth bit value is smaller than the first color depth bit value.

7. The display method for a display screen according to claim 6, wherein processing input image information into image data having a corresponding color depth bit value, comprises:

obtaining a resolution of each picture unit of the to-be-displayed picture;

when the resolution of a first picture unit is greater than a second preset threshold value, allocating the first picture unit to a first display control unit, and when the resolution of a second picture unit is not greater than the second preset threshold value, allocating the second picture unit to a second display control unit, wherein the first display control unit outputs the first picture unit comprising image data having the first color depth bit value, the second display control unit outputs the second picture unit comprising image data having the second color depth bit value, and the second color depth bit value is smaller than the first color depth bit value.

8. The driving circuit for a display screen according to claim 1, wherein:

the dividing the to-be-displayed picture into a plurality of picture units according to the picture parameter of to-be-displayed picture comprises dividing the to-be-displayed picture into the plurality of picture units in a nine-square grid manner or a ring division manner.

9. The display method for a display screen according to claim 6, wherein the filter is configured to divide the to-be-displayed picture into the plurality of picture units in a nine-square grid manner or a ring division manner.

* * * * *